US006684669B1

(12) United States Patent
Talpe

(10) Patent No.: US 6,684,669 B1
(45) Date of Patent: Feb. 3, 2004

(54) DOOR FASTENER DEVICE

(76) Inventor: Joseph Talpe, Oudenaardsesteenweg 543, Avelgem-Kerkhove, B-8581 (BE)

( * ) Notice: Subject to any disclaimer, the term of this patent is extended or adjusted under 35 U.S.C. 154(b) by 16 days.

(21) Appl. No.: 09/699,639

(22) Filed: Oct. 30, 2000

Related U.S. Application Data

(63) Continuation-in-part of application No. 09/367,158, filed as application No. PCT/BE98/00022 on Feb. 19, 1998, now abandoned.

(30) Foreign Application Priority Data

Feb. 19, 1997 (BE) ..... 9700153
Jan. 7, 1998 (BE) ..... 9800006

(51) Int. Cl.[7] ..... E05B 59/00; E05B 63/06

(52) U.S. Cl. ..... 70/107; 70/461; 292/1.5; 292/337; 292/340; 292/DIG. 60

(58) Field of Search ..... 70/107, 461; 292/340, 292/DIG. 60, 1.5, 337

(56) References Cited

U.S. PATENT DOCUMENTS

| | | | | | |
|---|---|---|---|---|---|
| 294,560 | A | * | 3/1884 | Woodrich et al. | |
| 671,792 | A | * | 4/1901 | Comber | |
| 1,154,499 | A | * | 9/1915 | Fischer | |
| 1,391,114 | A | * | 9/1921 | Huber | 292/340 |
| 1,541,992 | A | * | 6/1925 | Moriarty | 292/340 |
| 1,677,012 | A | * | 7/1928 | Arigi | 70/107 |
| 1,721,162 | A | * | 7/1929 | Moore | 292/173 X |
| 1,964,986 | A | * | 7/1934 | Hamm | 292/173 X |
| 3,892,110 | A | * | 7/1975 | Poli | 70/107 |
| 4,525,952 | A | * | 7/1985 | Cunningham et al. | 292/340 X |
| 4,662,666 | A | * | 5/1987 | Wimmer | 292/337 |
| 4,691,951 | A | * | 9/1987 | Fildan | 292/337 |
| 5,171,050 | A | * | 12/1992 | Mascotte | 292/340 X |
| 5,489,128 | A | * | 2/1996 | Florian | 292/1.5 |
| 5,704,666 | A | * | 1/1998 | Guillemette | 292/340 X |
| 5,765,411 | A | * | 6/1998 | Rowan | 70/101 |

FOREIGN PATENT DOCUMENTS

| | | | | |
|---|---|---|---|---|
| DE | 267252 | * | 11/1913 | 70/461 |
| DE | 338464 | * | 6/1921 | |
| DE | 345204 | * | 12/1921 | |
| DE | 1155363 | * | 10/1963 | |
| DE | 2458628 | * | 6/1976 | |
| EP | 341173 | * | 11/1989 | 292/DIG. 60 |
| EP | 374351 | * | 6/1990 | 70/461 |
| EP | 606196 | * | 7/1994 | |
| FR | 2596796 | * | 10/1987 | |
| FR | 495736 | * | 7/1992 | |
| FR | 2691497 | * | 11/1993 | |
| GB | 1153751 | * | 5/1969 | 292/340 |
| GB | 1171752 | * | 11/1969 | 292/340 |

* cited by examiner

*Primary Examiner*—Lloyd A. Gall
(74) *Attorney, Agent, or Firm*—Piper Rudnick LLP

(57) ABSTRACT

A fastener device, in particular for a door or a gate, more particularly a double door, including a lock including a frame with a carrier plate and an edge plate, the frame being arranged to be mounted with the edge plate against an upright, at least one bolt slidably mounted on the frame between a retracted and a projecting position and extending in its projecting position with a distal extremity over a predetermined distance out of the edge plate such as to extend through and project with a portion out of the upright when the lock is mounted against this upright, and an actuation mechanism arranged to move the bolt from its retracted to its projecting position and vice versa and including an operating member acting on an abutment element on the bolt, which abutment element is separated by a predetermined length of the bolt from the distal extremity thereof.

18 Claims, 11 Drawing Sheets

DOOR FASTENER DEVICE

RELATED APPLICATION

This is a continuation-in-part of U.S. Ser. No. 09/367,158, filed Aug. 9, 1999, now abondoned, which claims benefit of Belgian Application No. 9700153, filed Feb. 19, 1997, Belgian Application No. 9800006, filed Jan. 7, 1998, and International Application No. PCT/BE98/00022, with an international filing date of Feb. 19, 1998.

FIELD OF THE INVENTION

The present invention relates to a fastener device, in particular for a door or a gate, more particularly a double door, including a lock comprising: a frame with a carrier plate and an edge plate, the frame being arranged to be mounted with said edge plate against an upright; at least one bolt slidably mounted on the frame between a retracted and a projecting position and extending in its projecting position with a distal extremity over a predetermined distance out of the edge plate such as to extend through and project with a portion out of said upright when the lock is mounted against this upright; and an actuation mechanism arranged to move said bolt from its retracted to its projecting position and vice versa and comprising an operating member acting on an abutment element on the bolt, which abutment element is separated by a predetermined length of the bolt from said distal extremity thereof.

BACKGROUND

The lock described in EP-A-0 606 196 comprises a half-turn bolt operated by means of the handles and a dead bolt operated by means of a key operated cylinder. In this known lock, the distance over which both bolts project out of the edge plate is adjustable in order to allow mounting of the lock against uprights of different diameters.

For the half-turn bolt, this is achieved by making a series of cuts in the bolt which co-operate with a sprocket on the handle shaft so that the half-turn bolt can be retracted by means of the handles. The series of cuts in the bolt extends over a longer distance on the half-turn bolt than the distance between the retracted and the projecting position of this bolt so that the half-turn bolt can be mounted in different positions with respect to the sprocket in the lock. Since these different positions correspond with different distances over which the half-turn bolt projects out of the lock, the distance over which the half-turn bolt projects out of the lock can be adjusted by opening the lock and by mounting the half-turn bolt in the required position with respect to the sprocket on the handle shaft.

In order to make the dead bolt adjustable, three notches are provided in the lower side thereof, instead of the usual one notch, to co-operate with the driving bit of the key operated cylinder. On the upper side of the dead bolt, six cuts are provided, namely two cuts for each notch in the lower side. These cuts are arranged to co-operate with a locking member. One notch of each pair co-operates more particularly with the locking member in the projecting position of the dead bolt to lock the dead bolt in its projecting position and the second notch of each pair co-operates with the locking member in the retracted position of the dead bolt to lock the dead bolt in its retracted position. In order to adjust the distance over which the dead bolt projects in its projecting position out of the lock, the lock can be opened and the dead bolt can be mounted in three different positions in the lock, namely in those positions wherein the bit of the cylinder co-operates with the first, the second or the third notch in the lower side of the dead bolt.

A drawback of the lock disclosed in EP-A-0 606 196 is that for adjusting the distance over which the half-turn bolt or the dead bolt projects out of the lock, the lock has to be opened and the bolt has to be mounted in the required position in the lock. A further drawback is that there are only a limited number of discrete positions wherein the bolt can be mounted in the lock, for the dead bolt for example only three.

SUMMARY OF THE INVENTION

An object of the present invention is therefore to propose a new lock showing a bolt, in particular a latch and/or a dead bolt, which projects out of the lock over a distance which is adjustable without having to open the lock and mount the bolt in the required position.

To this end, the fastener device according to the present invention is characterised in that said bolt comprises a first part showing said distal extremity and a second part provided with said abutment element and means operable from said projecting portion of the bolt to move the first and second parts axially with respect to one another and to fix them to one another in different axial positions to adjust said predetermined length and thereby said predetermined distance over which the bolt projects out of the edge plate.

An essential difference with the prior art lock described hereabove is that the bolt comprises two parts which can be moved axially with respect to one another and fixed in different positions to one another. Since the distal extremity of the bolt is situated on the first bolt part and the abutment element onto which the actuating mechanism acts on the second bolt part, another mutual position of the two bolt parts corresponds to another distance over which the bolt projects out of the edge plate of the lock. Due to the fact that the means for moving and mutually fixing these two parts are operable from the portion of the bolt which projects out of the upright against which the lock is mounted, it is no longer necessary to disassemble the lock to adjust the distance over which the bolt projects out of the lock. Moreover, when the door onto which the lock is mounted is locked, the projecting portion of the bolt is not accessible so that the security of the lock is still guaranteed.

In a first particular embodiment of the fastener device according to the invention, said means for moving and fixing the first and second parts of the bolt in different axial positions to one another comprise a screw thread on said first bolt part and a corresponding screw thread on said second bolt part showing a screw axis directed according to a longitudinal axis of the bolt, the first and the second bolt parts being screwable onto one another over different overlapping distances to adjust said predetermined length of the bolt.

In this embodiment, the first bolt part can be screwed over the desired distance on the second bolt part. This embodiment is applicable to both a latch bolt or a dead bolt but especially to a dead bolt in view of the fact that it enables to maintain the notch or notches in the second bolt part to actuate the bolt in the usual way by means of the driving bit of the key operated cylinder.

Preferably, one of said screw threads is an inner and another of said screw threads an outer screw thread provided on a projecting portion of the part onto which this outer screw thread is provided, and an axial hole is provided through the distal extremity of the bolt until at least into said projecting portion, the hole being provided at least in said projecting portion with an internal screw thread and the lock comprises a set screw arranged to be screwed in said hole to lock said projecting portion in said inner screw thread by laterally expanding it therein. In this way, the set screw is inaccessible when the door is locked so that the first bolt part cannot be rotated with respect to the second bolt part when the door is locked thus providing an increased security.

In a second particular embodiment of the fastener device according to the invention, said second bolt part comprises a slide element which is slidably mounted in said first bolt part and which is provided with said abutment element, said means for moving and fixing the first and second bolt parts in different positions to one another comprising a threaded shank extending axially within the first bolt part and engaging the slide element and the first bolt part, which threaded shank is accessible through an axial hole provided in said distal extremity to rotate it either clockwise or anti-clockwise to slide said slide element axially in the first bolt part.

In this embodiment, the position of the abutment element with respect to the first bolt part and thus the distance over which the bolt projects out of the lock can easily be adjusted by rotating the threaded shank through the axial hole in the bolt, for example by means of a hexagonal key or a screw driver. This embodiment can easily be applied to the latch bolt but also to the dead bolt.

Preferably, said threaded shank is mounted freely rotatable in one predetermined position in the first bolt part and is screwed in an axial threaded hole in said slide element. In this way, a translation movement of the slide element in the axial direction of the bolt can easily be obtained by a rotation of the threaded shank.

In a further particular embodiment, the fastener device comprises at least one handle rotatably mounted on a handle shaft and a follower mounted in this shaft and the aforementioned operating member comprises a ring comprising a cylindrical external profile delimited by two practically parallel sides and a stub arranged radially on the outside periphery of this cylindrical profile to act on the abutment element on the latch bolt, the said ring being attached via one of the aforementioned sides to the follower (18) forming a hub so as to form an annular groove in which a return means for said handle is housed. The aforementioned operating member thus operates the bolt reliably and effectively. Furthermore, the construction of the operating member and the abutment element proves simple and inexpensive. The abutment element may for example be formed by a projecting element attached to the lateral surface of the latch bolt. Furthermore, the space required by the means for returning the handle is eliminated, because it is housed in the operating member thereof. What is more, this arrangement gives effective protection to the return means against external disturbances.

BRIEF DESCRIPTION OF THE DRAWINGS

Further advantages and particularities of the invention will become apparent from the following description of some particular embodiments of the fastener device according to the invention. This description is only given by way of illustrative example and is not intended to limit the scope of the invention as defined by the annexed claims. The reference numerals used in the description refer to the drawings wherein:

DETAILED DESCRIPTION

The present invention generally relates to a fastener device, particularly for a door, with a lock. The fastener device described is applicable especially to any type of opening leaf, such as a gate, barrier, or swing door provided with a profiled lateral side or upright 19 in the form of a tube as in the example described hereafter, and generally of any size.

Figure 1:
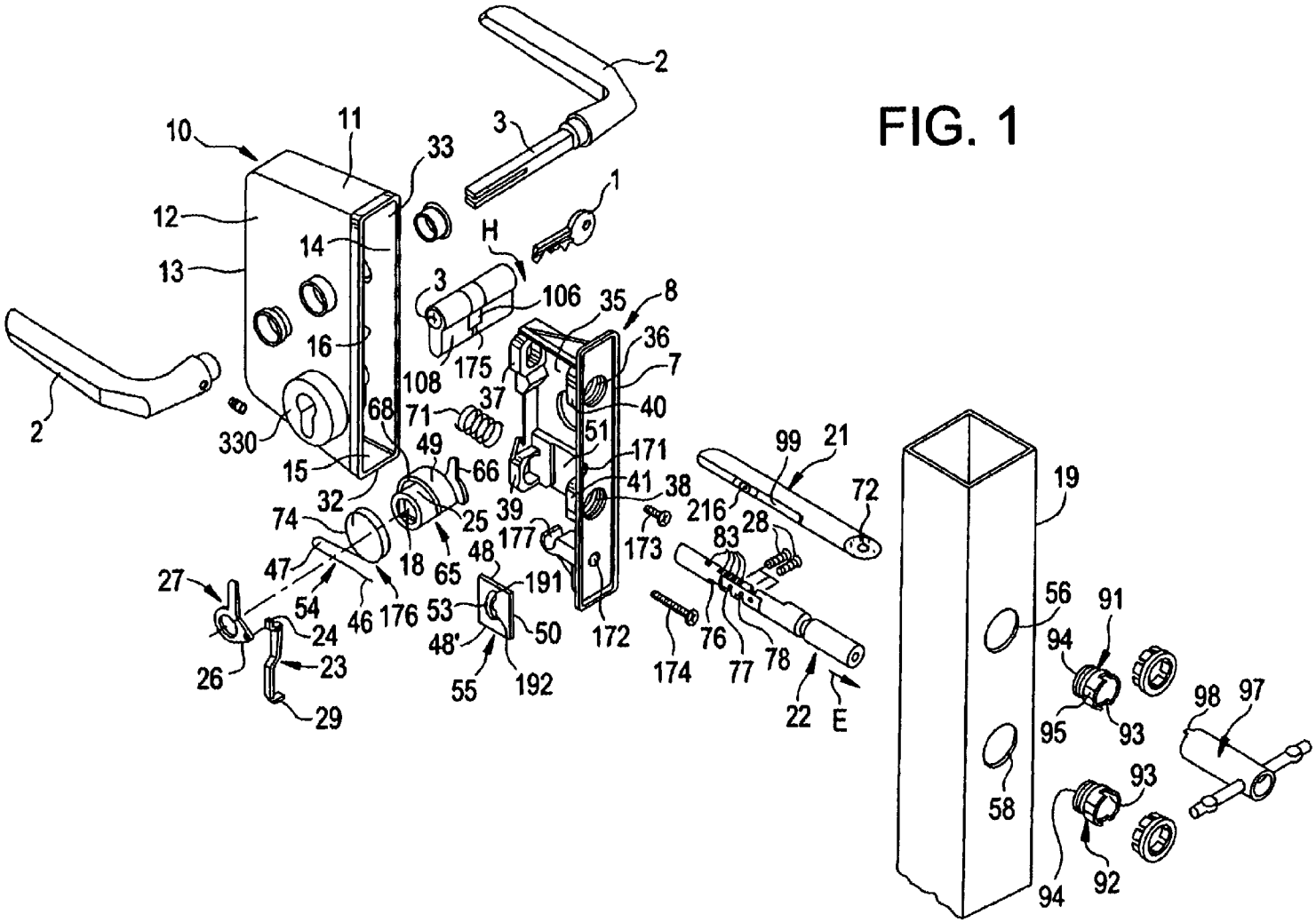
FIG. 1 represents a partially exploded perspective view of a first embodiment of the fastener device according to the invention.

Illustrated in FIG. 1 is the device with a lock, which device comprises a casing 10 in which there is housed the lock 8 comprising a frame with a carrier plate 35 and an edge plate 7 arranged to be mounted against the upright 19. The lock casing 10 represented in FIG. 1 is in the form of a one-piece body incorporating the frame 35, 7 into a case with six faces 11, 12, 13, 14, 15 and 16. On one of its faces 16, the casing forming a case 10 has an opening 33 intended to accept the edge plate 7 which is independent of the casing proper.

Thanks to the one-piece structure of the casing, it is possible to obtain a fastener device the security of which is considerably enhanced because the lock 8 is housed within the casing 10 installed in the door. Effectively the only access to the lock 8 is through the lateral opening 33 which is closed off by the edge plate 7. This edge plate is immobilised in front of the tubular profile 19 on which the fastener device is mounted and is further fixed to the casing by means of a screw 173 extending through an opening 171 in the edge plate and by means of a screw 174 extending through an opening 172 in the edge plate and screwed in a threaded transverse drilling 175 in the lock cylinder 108 resting in a retaining tab 177 provided on the carrier plate. The lateral opening 33 is thus perfectly inaccessible which removes any possibility of access to the lock mechanism housed in the casing 10. Furthermore, the one-piece structure of the casing 10 has the advantage of making the latter easier to mount in the door and of thus considerably reducing the fitting time. The size of the assembly formed by the casing and the edge plate is thus reduced.

Advantageously, the edge 32 surrounding the opening 33 and the edge of the edge plate 7 have a bevelled profile allowing one to be fitted into the other quickly and reliably.

The casing 10 is intended to house a lock mechanism allowing at least one bolt to be operated, preferably a latch bolt 21 and a dead bolt 22. In order to make the fastener device suitably secure, each bolt 21, 22 is sufficiently long. The bolts 21, 22 are mounted so that they can slide axially in the fastener device. In order to allow the bolts to slide, passages 36, 38 are provided in the edge plate 7 as well as in the tubular profile 19. The passages 56, 57 and 58, 59 which are provided to allow the latch bolt 21 and dead bolt 22 respectively to pass through the tube 19 are arranged opposite each other on the periphery of the tube 19 and in line with the corresponding respective passage 36, 38 in the edge plate 7. The carrier plate 35 is attached to the edge plate 7 at right angles at a longitudinal edge thereof. The shape of the plate 35 is advantageously adapted to suit the internal shape of the casing 10. Elements 37, 39 for guiding the bolts 21, 22, for example a guide eye attached to the carrier plate 35, are arranged in line with the aforementioned bolt passages 36, 38. Given the relatively pronounced length of each of the bolts, 21, 22 it is important to make sure that these are very stable as they are guided in their axial sliding in the direction of the arrows denoted by F. To this end, the guide elements 37, 39 are attached to that edge of the carrier plate 35 which is opposite the edge to which the edge plate 7 is attached, thus giving a maximum distance between the two points of guidance of each bolt 21, 22.

Figure 2:
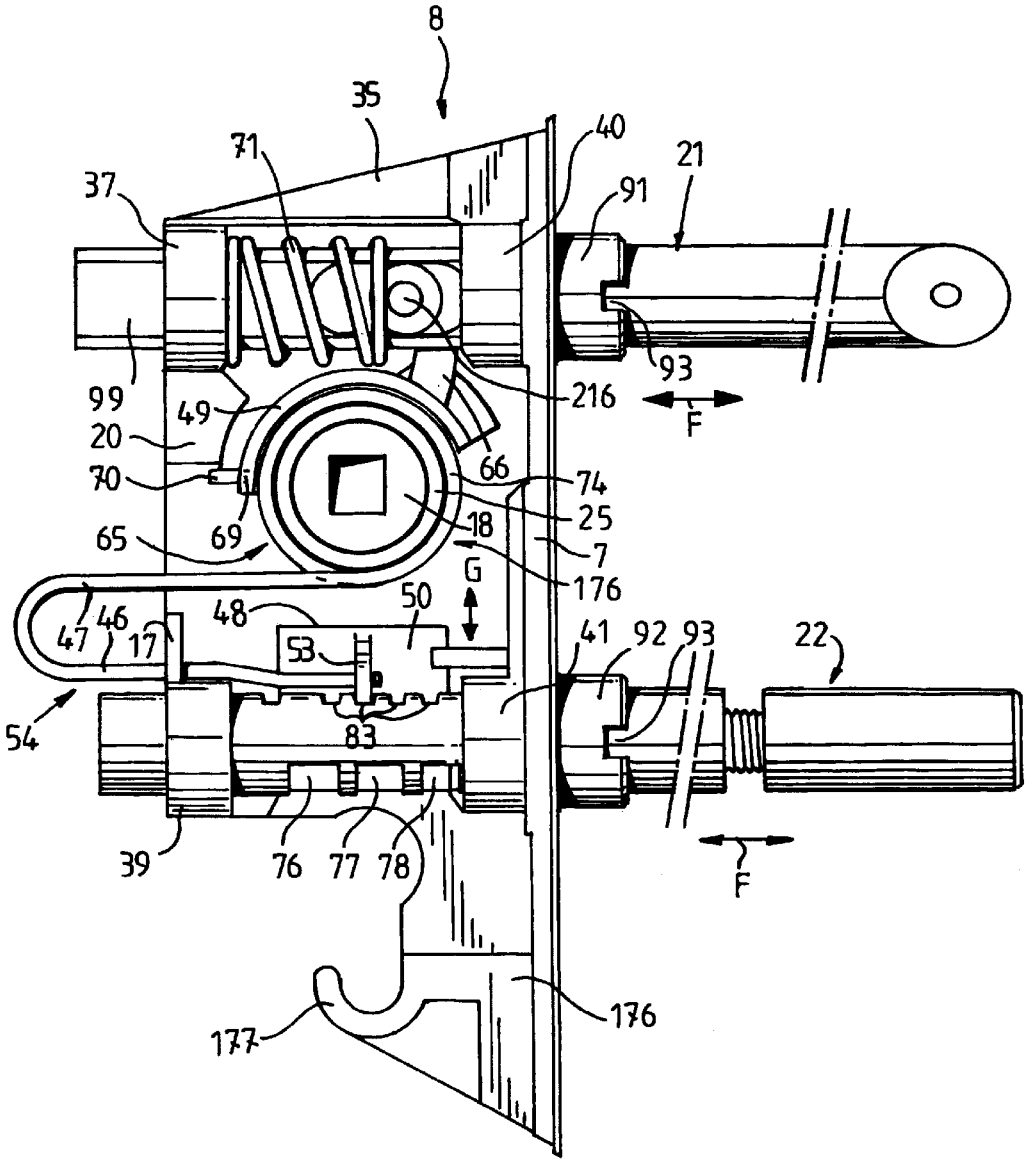
FIG. 2 illustrates a view in internal section of the fastener device illustrated in FIG. 1, showing the operation thereof.

As visible in FIGS. 1 and 2, an additional guide eye 40, 41 is provided for each bolt in the extension of each bolt passage 36, 38, thus increasing the area over which each bolt is supported, and therefore its stability.

In the example hereafter, a description is given of a mechanism for operating the latch bolt 21 and the deadlock bolt 22. For each bolt the lock 8 comprises an actuation mechanism allowing the bolt to be moved between a retracted position and a projecting position wherein it extends with its distal extremity over a predetermined distance out of the edge plate 7 to extend through and project with a portion out of the upright 19. In particular, the exemplary structure of the actuation mechanism 65 for the latch bolt 21 described hereafter allows a rotational movement of an operating member 66 driven by a handle 2 to be converted into a translational movement of the latch bolt 21. The actuation mechanism of the dead bolt 22 comprises a lock cylinder 108 operated by means of a key 1 and having a driving bit 106 as the operating member for the dead bolt 22. Each bolt 21,22 is intended to engage in the aforementioned tubular profile 19 under the direction of the respective actuating mechanism. However, the lock illustrated in FIG. 1 comprises moreover a second turn pusher 23 having one extremity 24 hooked in a hole 26 in a second turn lever 27 which is mounted freely rotatable onto the shaft of the handles 2. The second turn pusher 23 is maintained between two screws 28 screwed in the lateral side of the dead bolt 22 in such a manner that when the dead bolt 22 is moved by means of the lock cylinder 108 in its retracted position, the lower extremity 29 of the second turn pusher is moved in the circular path followed by the bit 106 of the lock cylinder so that, upon a further rotation of the key 1, the bit 106 pushes the second turn pusher 23 upwards to rotate the second turn lever 27 which acts upon the latch bolt 21 to move this bolt also in its retracted position without having to use any handle 2. In this embodiment, the handles can therefore be omitted. For clarity's sake, the second turn pusher and lever have not been shown in FIG. 2.

In the fastener device, the actuation mechanism 65 for the latch bolt 21 advantageously comprises a wheel 25 which has an operating member 66 forming a lever, such as a stub 66 on its periphery. The stub 66 is intended to come into engagement with a corresponding abutment element 224 such as a projecting element provided on the latch bolt 21. The wheel 25 is designed to be substantially concentric about the follower 18 arranged to receive the shaft 3 of the handles 2. The wheel is rendered integral with the follower 18 and with a cylindrical envelope 49 partially surrounding the wheel 25 so as to form an annular groove 68.

An elastic return means 71 is provided to return the latch bolt 21 to its position of rest. Advantageously, these return means 71 allows the latch bolt to be retracted and deployed without the stub 66 or the handle 2 having to move. As a preference, the aforementioned return means 71 consists of a compression spring arranged coaxially around the latch bolt 21. In this respect, the spring 71 advantageously has a contour of oval cross section closely following the two mutually opposed side walls 99 of the latch bolt, pressing against the projecting elements 224, 225 and thus advantageously being wound around the latch bolt 21, furthermore allowing the position of the latch bolt to be reversed. Furthermore, by virtue of the spring 71 of the latch bolt 21, the latch bolt 21 can be brought into a retracted or projecting position without the lever 66 or the handle 2 having to be moved and/or operated.

Another return means, arranged to return the handles 2 to their rest position, is produced in the form of a spiral spring 74 wound around the follower 18 in the aforementioned annular groove 68 to act on the wheel 25. To ensure that the spring is held firmly, a notch 69 is provided in one end of the cylindrical envelope 49. The notch 69 therefore acts as a housing for one end 70 of the spring. This end 70 is not only intended to engage the actuation mechanism 65 to urge it to its rest position but also to limit the travel of the actuation mechanism 65. To this end, the carrier plate 35 on its leading edge has a stop 20 intended to limit the travel of the end 70 of the spring 74 and therefore of the wheel 25. As a preference, the follower and wheel assembly is arranged between the latch bolt 21 and the deadlock bolt 22.

Furthermore, the thickness of the wheel 25 is preferably less than the diameter of the latch bolt 21. The spiral spring 74 for its part is fully housed in the annular groove 68. This arrangement of the spring and of the wheel makes this fastener device more compact and it therefore has the advantage of considerably reducing the size thereof. As a preference, the spiral spring 74 is made of metal.

Figure 3:
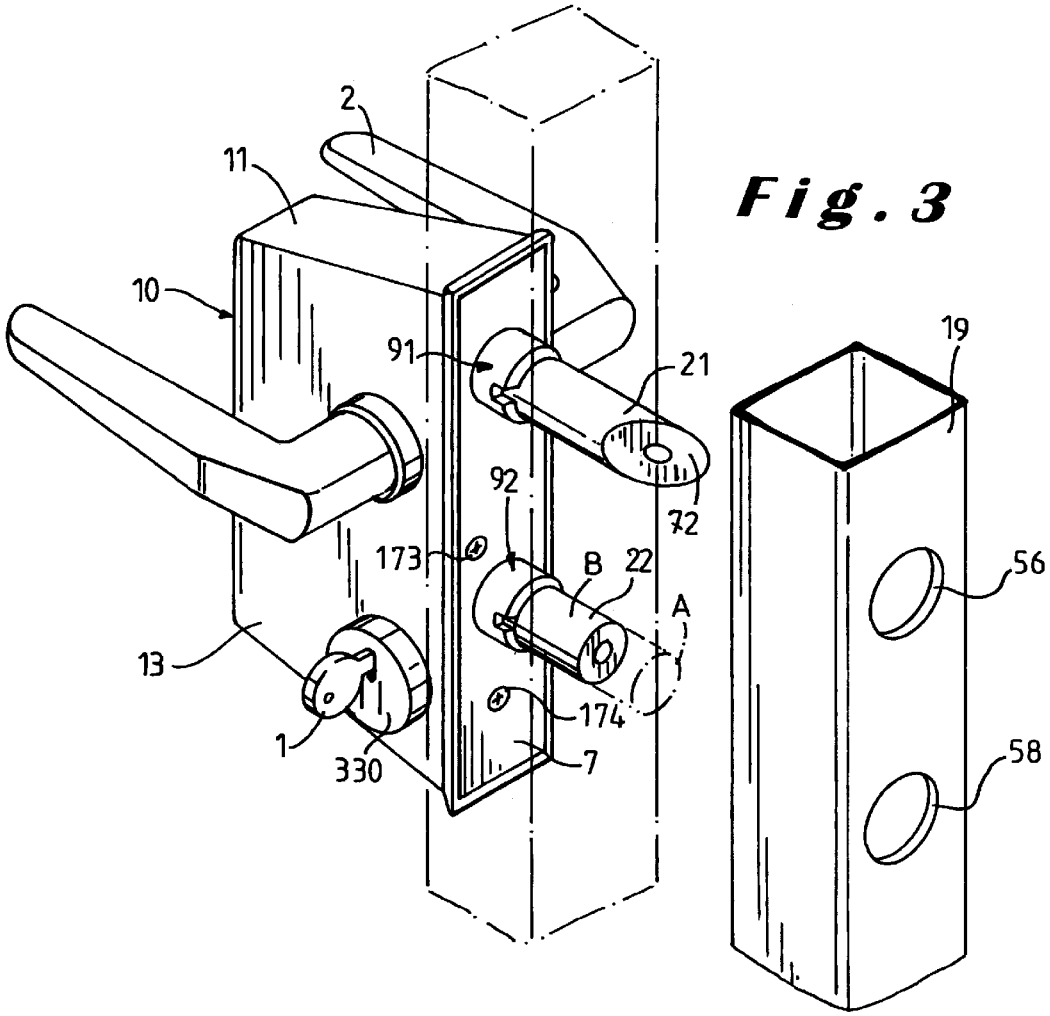
FIG. 3 represents the device according to FIG. 1 in the mounted condition.

As already described hereabove, the actuation mechanism of the dead bolt 22 is formed by a standard lock cylinder 108 whose operating member is formed by a rotary bit 106. To move the dead bolt between its retracted and projecting positions by means of the bit 106, it is provided at its lower side with at least one notch as abutment element for the bit 106. In the embodiment illustrated in the drawings, the dead bolt has more particularly an axial row of three notches 76, 77, 78 allowing to adjust the distance over which the dead bolt projects out of the lock by mounting the dead lock in the desired position in the lock, i.e. in one of the positions wherein either the first, the second or the third notch co-operates with the bit 106 of the cylinder 108. On its upper side, the deadlock bolt 22 has further an axial row of cuts 83 to co-operate with a means for locking the dead bolt in its retracted and projecting positions. These two positions are indicated in FIG. 3 by reference A and B. In the illustrated embodiment, the dead bolt shows therefore two cuts 83 per notch. The cuts and notches preferably each extend transversely with respect to the axis of the bolt 22. In each row, the profile of the notches and cuts respectively is practically identical. The row of cuts points towards the operating member 65.

Facing the row of cuts 83, a locking member 55 acting as a catch is arranged so that it can slide transversely with respect to the direction of sliding of the deadlock bolt 22, between this bolt 22 latter and the carrier plate 35. The locking member is formed, for example, of a sliding small plate 50. Provided on the carrier plate 35 is a guide 51 allowing the small plate 50 to slide up and down upon rotation of the drive bit. The small plate 50 preferably has a substantially rectangular shape and thus has a leading edge 48 and a trailing edge 48'. The small plate 50 is provided with a loop 53 projecting from the small plate starting from the inside of the small plate as visible in FIG. 1. The small plate 50 is housed so that it can slide in the aforementioned guide 51 between the bolt 22 and the carrier plate 35, the loop 53 pointing out-wards so as to come into engagement with the cuts 83 of the deadlock bolt. When the bit 106 of the cylinder 108 is rotated to move the dead bolt to its retracted or its projecting position, it first engages the trailing edge 48' of the locking member 55 so as to lift this locking member to move the loop 53 out of the cuts 83 thereby unlocking the dead bolt. This arrangement of the locking member is particularly advantageous because of its very small size and because of its reliability.

Another return means 54 is provided facing the loop 53 so as to return the small plate 50 to its position of rest after being lifted by the bit 106 of the lock cylinder. This return means is formed, for example, of a spring of the elongate type with two branches 46, 47 in the shape of a hairpin. The branches 46, 47 of the spring are very long so as to ensure effective return of the small plate to its position of rest without requiring too high a pressure to be exerted on this plate thanks to the lever-arm effect obtained by the length of the branches 46, 47 of the spring 54 which, as a preference, is also made of metal.

The means 54 for returning the locking member 55 to its rest position and the return means 74 for returning the handles 2 to their rest position are advantageously combined into a single spring 176. Thus the hairpin spring 54 is attached via one of its branches 47 to the spiral spring 74, at the free end thereof. The spring 54 extends outside of the annular groove 68, the cylindrical envelope 49 of the wheel 25 advantageously being interrupted over a part of its periphery. This allows convenient passage of the spring 176 as visible in FIG. 2. The interruption region is formed, for example, of a peripheral cutout delimited laterally by two shoulders allowing the wheel 25 to rotate despite the presence of the return spring 176 which remains practically in place.

As a preference, the loop 53 is arranged on a middle axis of the small plate 50 so as to give better balancing of the forces acting on it. Advantageously, the loop is stamped out of the small plate without removal of material. This considerably favours the robustness and the firmness with which the loop is attached to the small plate. The loop 53 is attached to the small plate at an internal point thereof and extends linearly at a predetermined slope. As is visible in FIG. 1, the loop 53 may, however, just as easily be attached to the small plate at two internal points 191, 192 so as to form an eyelet for the passage of the branch 46 of the spring 54.

Figure 19:
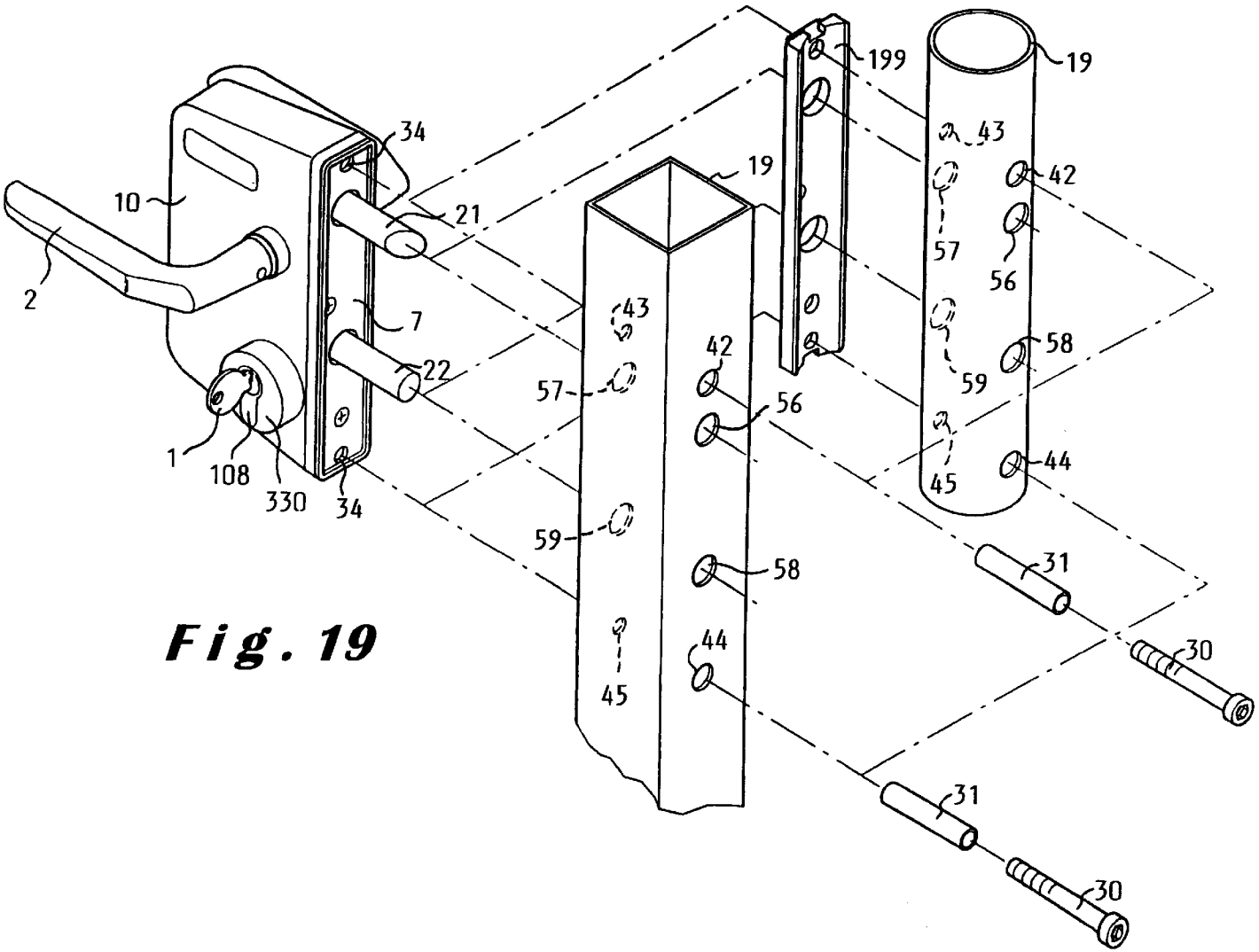
FIG. 19 illustrates how the lock shown in FIG. 1 can be mounted on a square and on a circular upright.

For fixing the lock to the tube 19, different fixing means can be provided. In the embodiment illustrated in FIG. 19 additional holes 42, 43, 44, 45 are made in the tube 19 for screws 30 and bushings 31 which can be screwed in threaded holes 34 in the edge plate 7. As shown in FIG. 19 an adapter plate 199 can be provided to allow an edge plate 7 for a square profile to be adapted to suit a round profile. The aforementioned adapter plate 199 also makes it possible to even out the roughnesses on the tubular profiles, because of its hollow configuration as emerges from FIG. 19.

In the preferred embodiment illustrated in FIG. 1, the fixing means for mounting the lock to the tube 19 comprise however bushings 91, 92 intended to be screwed with one of their respective ends 94 into the aforementioned bolt passages 36, 38. The ends 94 of the bushings 91, 92 are advantageously threaded and the bolt passages 36, 38 tapped to suit over sufficient depth so as to give a secure connection between the support tube 19 and the fastener device.

The bushings 91, 92 are engaged in the passages 36, 38 via the aforementioned openings 56, 57 and 58, 59 respectively through which the latch bolt and the dead bolt extend through the tube 19. In order to tighten the bushings 91, 92 appropriately into the passages 36, 38, the bushings 91, 92 are provided at their respective opposite ends, on their periphery, with at least one engagement means such as notches 93. The bushings 91, 92 are tightened into the passages 36, 38 therefore using an appropriate ring or box spanner 97 the length of which is substantially greater than the section of the tube 19 so as to allow the spanner to be worked from the outside. The diameter of the spanner 97 corresponds substantially to the diameter of the periphery of the end of the bushing which has the notches 93. At least at one end the spanner 97 has two projections 98 intended to interact with the notches 93. Thus access to the bushings becomes more difficult once they have been placed inside the tube 19.

As visible in FIG. 1, the bushings in the non-threaded region have a wider head portion 95 forming a shoulder allowing the tube 19 to be held against the edge plate 7. Fixing the fastener device to the tube 19 via the bushings 91, 92 making use of the openings 56, 57 and 58, 59 which at the same time are intended for the passage of the bolts 21 and 22 makes it possible to limit the number of openings made in the tube 19. In addition, the relatively large area of engagement between the bushings and the tapped passages 36, 38 increases the stability of the connection between the tube 19 and the fastener device.

Furthermore, it is advantageously possible to provide a special peripheral arrangement of notches 93 in the bushings 91, 92, each having a special profile. In the example illustrated, two diametrically opposed notches are provided, each having a rectangular profile. The advantage lies in the fact that undoing the bushings 91, 92 requires a spanner 97 which has an end that has a corresponding profile. This thus strengthens the security of the fastener device and therefore its reliability because the bushings can be personalized and the undoing thereof made possible only by authorized individuals.

More particularly, each bushing is axially hollow, the interior wall being of a cylindrical appearance. Correspondingly, the bolts also have a generally cylindrical appearance, at least over part of their length. This gives the bushings 91, 92 yet another advantage. As they are arranged along the axis of sliding of the bolts, the bushings in effect form an additional guide for the bolts, as visible in FIG. 2, thus contributing to their stability.

An important advantage of the lock illustrated in the drawings is that the distance over which the latch bolt and the dead bolt project out of the edge plate can be adjusted from the outside of the lock to fit different diameters of the upright or tube 19 to which the lock is to be mounted.

As described hereabove, the dead bolt 22 is provided with a series of cuts 83 and notches 76, 77, 78 which enable however to adjust the distance over which the dead bolt projects out of the lock only by disassembling the lock. In order to avoid having to disassemble or open the lock to adjust this distance, the dead bolt 22 illustrated in FIG. 1, and more into detail in FIGS. 6 and 7, comprises a first part 201 forming the free extremity of the dead bolt 22 and a second part 202 which shows the abutment element or elements, in the illustrated embodiment the notches 76, 77, 78, onto which the operating member acts to move the dead bolt from its retracted to its projecting position and vice versa. An essential feature of this dead bolt is that the two parts 201 and 202 can be fixed by means, operable from the portion of the bolt which projects out of the upright in the projecting position of the bolt, in different axial positions to one another resulting in different lengths of the bolt between the abutment element and the distal extremity 203 of the bolt or in other words in different distances over which the bolt projects out of the lock. In this way the lock does not have to be opened to adjust the distance over which the dead bolt projects out of the lock.

Figure 6:
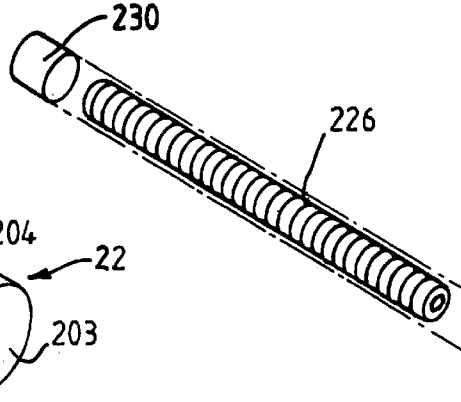
Figure 6:
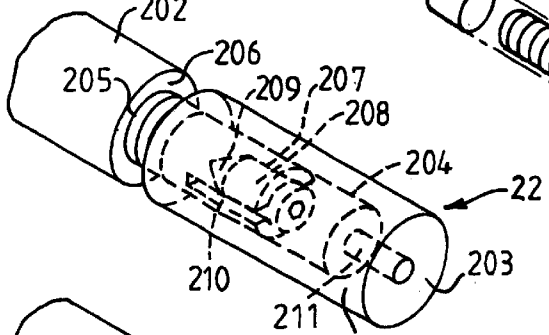
Figure 7:
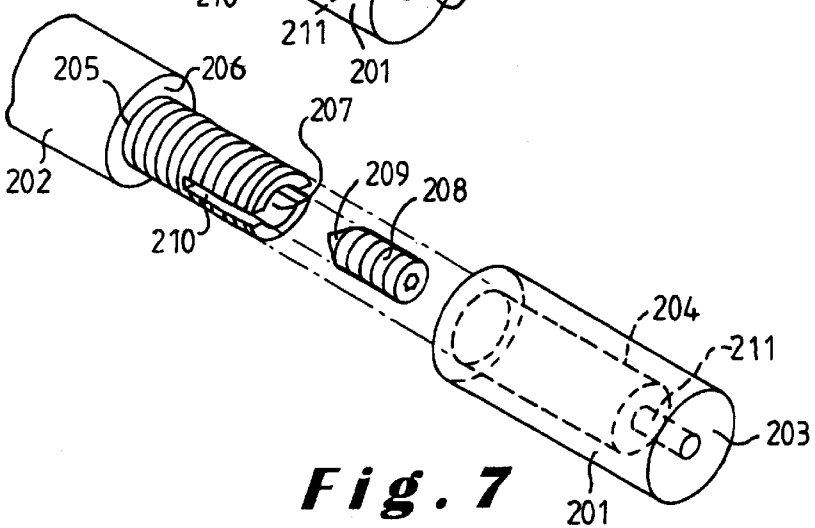
Figure 8:
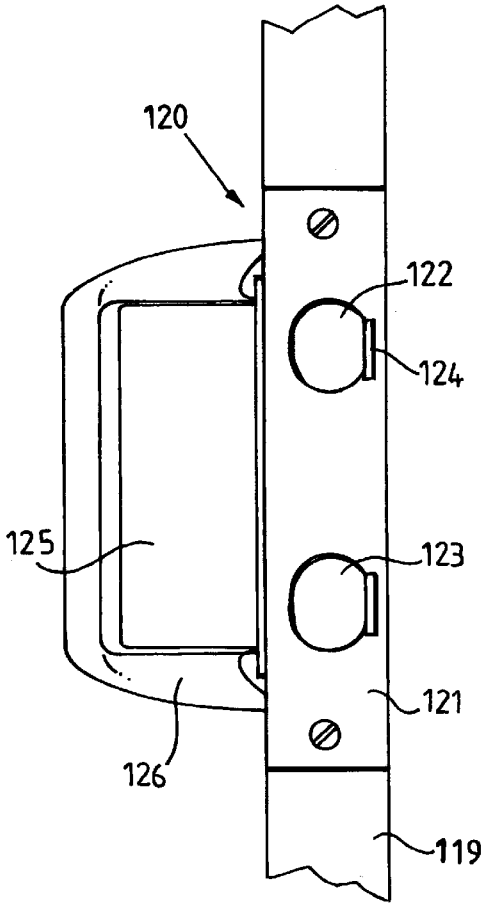
FIGS. 8 to 10 illustrate various views of a striker-plate part for the lock mounted on an opposite upright.
Figure 9:
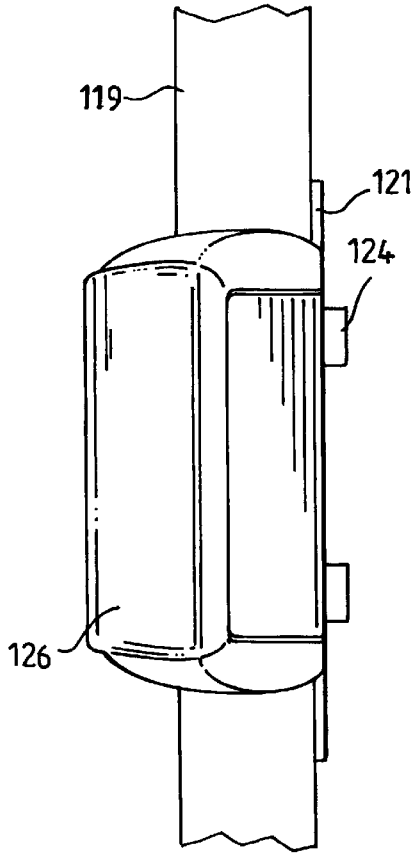
Figure 10:
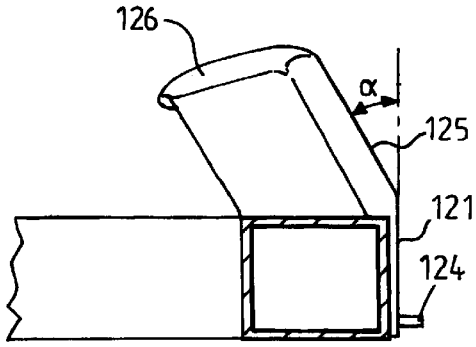

In the embodiment illustrated in detail in FIGS. 6 and 7, this is achieved by a screw connection between the two bolt parts 201 and 202 which enables screwing the two bolt parts onto one another over different overlapping distances. The first bolt part 201 is provided more particularly with an axial hole 204 provided with an inner screw thread whilst the second bolt part 202 shows a projecting portion 205 separated by a shoulder 206 from the main portion of the second bolt part 202 and having a reduced diameter, corresponding to the inner diameter of the hole 204 provided in the first bolt part. Due to the fact that the projecting portion 205 of the second bolt part shows a same screw thread as the screw thread in the hole 204 in the first bolt part, this first bolt part can be screwed over the desired distance on the projecting portion of the second bolt part by simply rotating the first bolt part.

In order to be able to lock the first and second bolt parts to one another so that, for safety reasons, the first bolt part cannot be rotated when the door is locked, the projecting portion 205 of the second bolt part 202 is provided with a threaded axial hole 207 showing a conical bottom, i.e. a tapering portion, wherein a set screw 208 showing a pointed tip 209 can be screwed. In the area of the axial hole 207 the projecting portion is divided by an axial cut 210 into two halves so that when the set screw is screwed with its tip into the conical bottom, the two halves of the projecting portion are urged away from one another, or so that the projecting portion of the second bolt part is clamped or locked in the axial hole 204 provided in the first bolt part 201. In order to be able to tighten or release the set screw, the axial hole 204 ends through a narrower portion 211 in the distal extremity 203 of the dead bolt so that, when the door is open, a hexagonal key or a small screw driver can be inserted through this hole into the set screw 208.

The above described mechanism for adjusting the distance over which the dead bolt projects out of the lock can also be applied to the latch bolt 21. The preferred embodiment illustrated in detail in FIGS. 4 and 5, differs however from the embodiment applied to the dead bolt 22. In both embodiments the bolt comprises a first bolt part which shows the distal extremity of the bolt, a second bolt part which is provided with the abutment element onto which the operating member acts, and means operable from the portion of the lock which projects out of the upright to move the first and second bolt parts with respect to one another and to fix them in different axial positions to one another to adjust the length of bolt between the abutment element on the second bolt part and the distal extremity of the first bolt part and thus the distance over which the bolt projects out of the lock.

Figure 4:
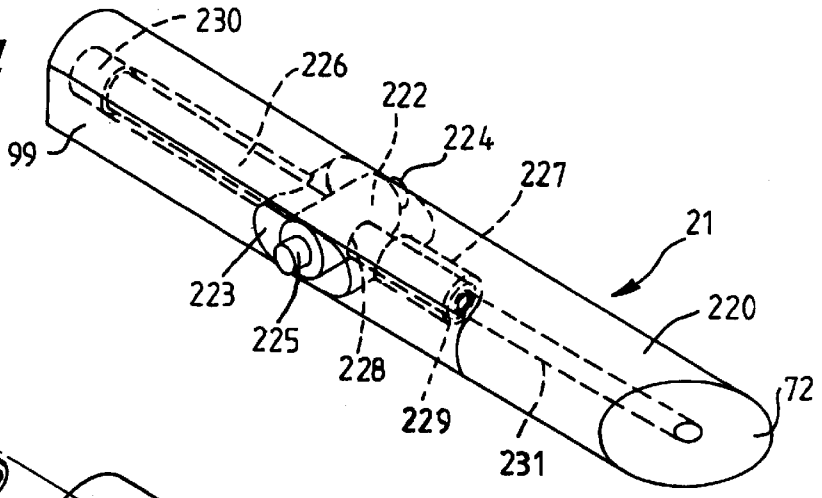
FIGS. 4 to 7 represent views showing the latch bolt and the dead bolt of the lock illustrated in the previous figures on a larger scale and according to an exploded view.
Figure 5:
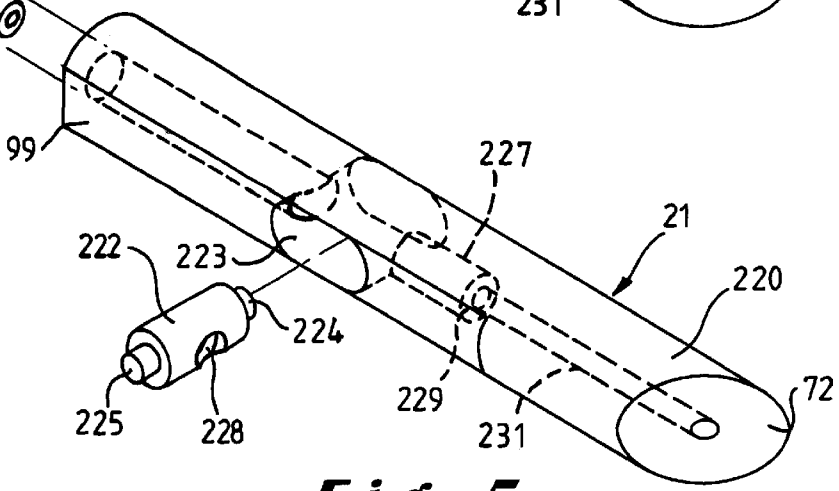

In the embodiment illustrated in FIGS. 4 and 5 the first bolt part 220 forms the main body part of the latch bolt 21 showing the distal extremity 72 whilst the second bolt part is formed by a slide element 222 which is slidably mounted in the first bolt part 220. The slide element 222 is arranged in a slot 223 in the first bolt part 220 which has two opposite extremities between which the slide element 222 can be displaced. The slide element extends transversally entirely through the first bolt part 220 and has two abutment elements located outside the first bolt part, namely a first abutment element 224 for the actuation mechanism 65 operated by the handles 2 and a second abutment element 225 for the second turn lever 27 operated by the lock cylinder 108. The means for moving and fixing the slide element 222 to the main bolt part 220 comprises a threaded shank 226 which is positioned in an axial hole 227 in the main bolt part 220 and which extends through a threaded hole 228 provided in the slide element 222. The axial position of the threaded shank 226 in the hole 227 is fixed due to the fact that it engages with one end a shoulder 229 in the axial hole 227 and with the opposite end a stop 230 clamped or screwed in the hole 227 to close it off. In this way, the slide element 222 is not only fixed by the threaded shank in the main bolt part 220 but can be moved axially in the slot 223 in this main bolt part by rotating the threaded shank 226 either clockwise or anti-clockwise. The threaded shank 226 can more particularly be rotated, when the door is open, by means of a hexagonal key or by means of a small screw driver through a portion 231 of the axial hole 227 which has a smaller diameter than the portion of this axial hole wherein the threaded shank 226 is situated and which extends between the shoulder 229 and the distal extremity 72 of the latch bolt 21.

The fastener device illustrated in the drawings, especially in FIGS. 8 to 11, does not only contain a lock but also a means or keep 120 for accepting this lock, particularly the latch and/or dead bolt, for which it is specifically designed. The keep 120 is more particularly designed to be arranged on an opposite upright 119 facing the upright 19 on which the lock 8, 10 is mounted. More specifically, the aforementioned accepting means or keep 120 comprises an accepting plate 121 in which there is provided at least one accepting orifice 122, 123 for each corresponding bolt in alignment therewith, and a grab plate 125 attached and intended to be grasped by the user. Behind the orifices 122 is arranged a projecting portion 124 forming an abutment or catching element for the door. The perforated accepting plate 121 and the grab plate 125 form an angle $\alpha$, for example between 35 and 55°, preferably approximately 45°, between them. The grab plate 125 is fitted with an element 126 forming a handle which is attached to it. More specifically, the handle element 126 is made of a synthetic material, preferably applied to the plate 125 by injection moulding.

The aforementioned accepting means 120 acts both as an accepting plate for the introduction of the latch bolt and as a means of consolidating the locking effect through the presence of notches or a slot in which the bolts can be locked and, when mounted on a second leaf of a revolving double door, also acts as a handle allowing the second leaf to be opened. Thus, the striker plate-forming accepting means 120 acts simultaneously as an accepting plate with a carrier plate 125 for the handle to drive back the latch bolt 21 to its retracted position when the door is closed, as a plate for locking the bolts, and as a handle.

Figure 11:
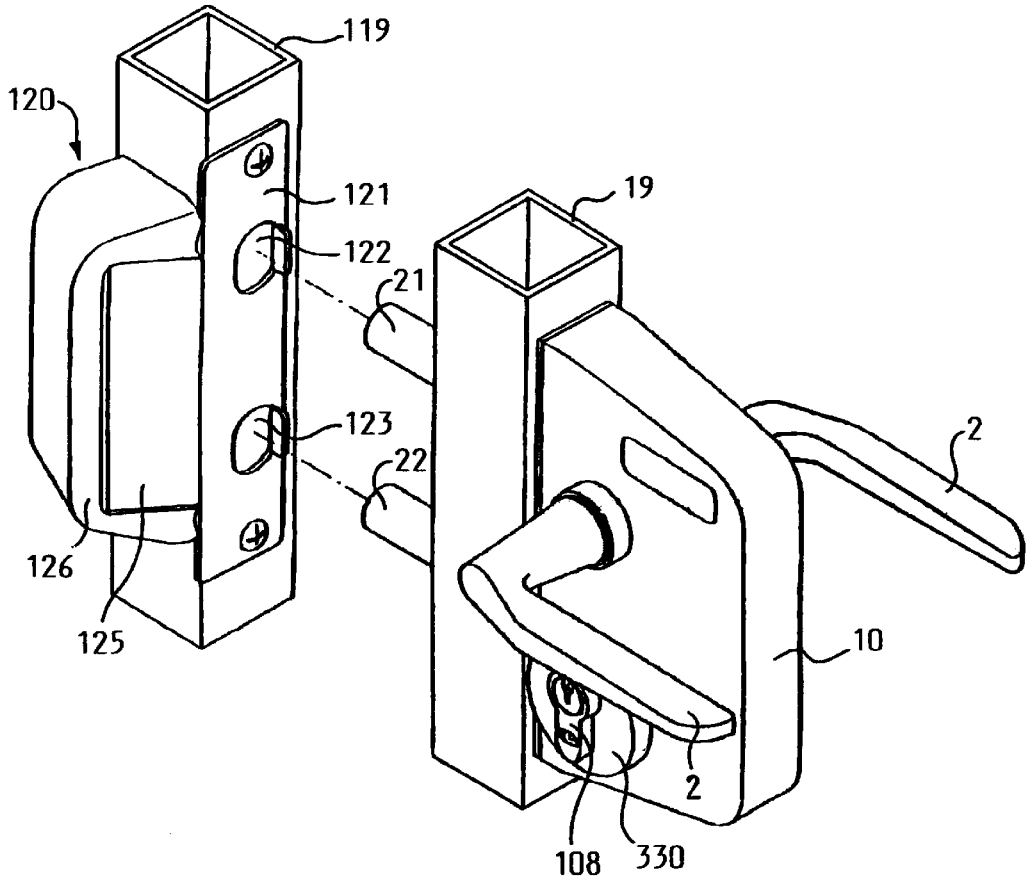
FIG. 11 illustrates the way in which the lock part of the device according to FIGS. 1 to 3, on the one hand, and the striker-plate part of the device according to FIGS. 8 to 10, on the other hand, interact.

FIG. 11 clearly illustrates the use of the plate 120 that accepts the bolts 21, 22 of the lock as a handle 126 for opening the second leaf of a double door.

Advantageously, the latch bolt 21 co-operates directly with the integral handle 125, 126 and therefore has a bevelled distal extremity or end 72. As a preference, the angle of the bevel 72 corresponds substantially to the angle $\alpha$ of the built-in handle 126. This advantageously allows the corresponding leaf of the door to be closed simply by slamming the door without having to manipulate the lock. As a preference, the bevelled surface 72 of the free end of the latch bolt 21 is slightly domed so that there is no line of contact between the bolt and the accepting surface against which this 21 abuts.

Figure 12:
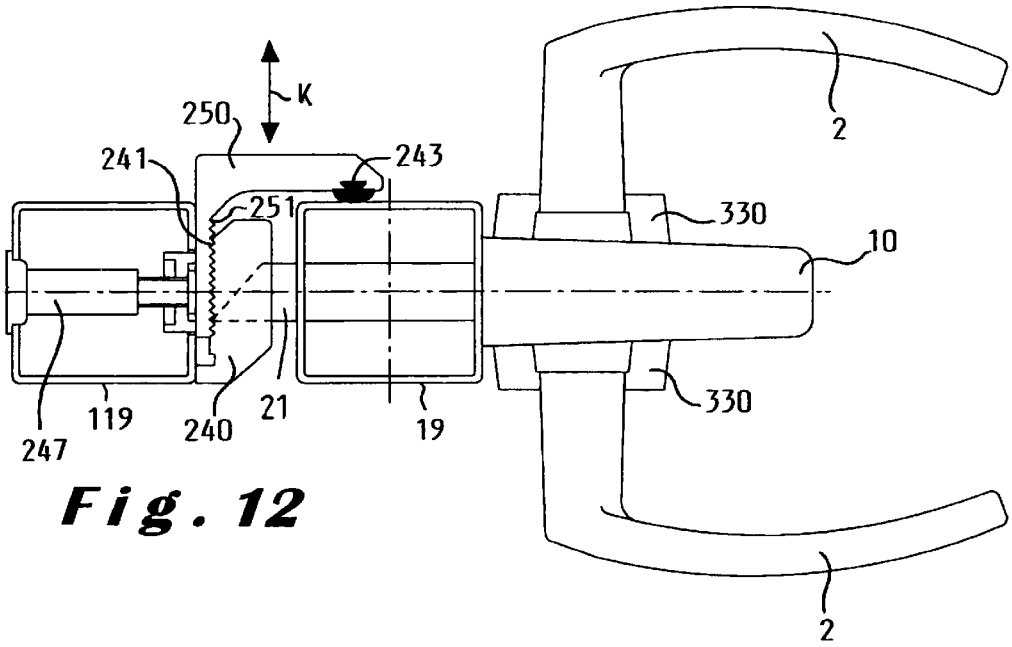
FIGS. 12 and 13 illustrate a view from above of a first alternative form of the device represented in FIG. 11 in the mounted state with an additional adjusting element incorporated.
Figure 13:
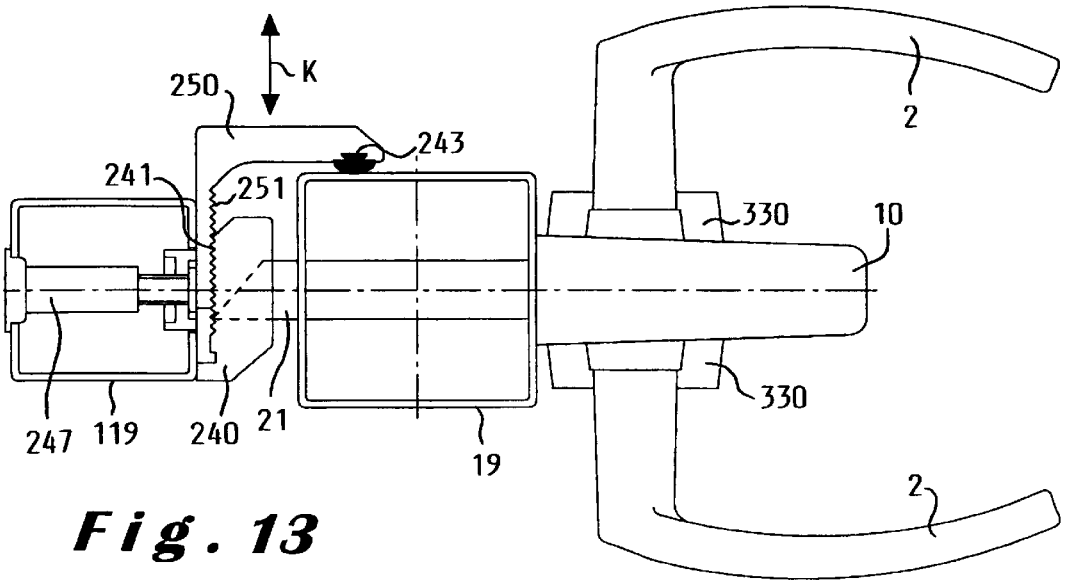

FIGS. 12 and 13 illustrate a further form of the fastener device which differs from the embodiment in FIGS. 8 to 11 by the fact that it does not show a handle but that it enables an adjustment to different diameters of the upright to which the lock is mounted. It comprises a door stop 240 co-operating with a catching plate (door stop/lock) 250 via engaging means 241 and 251 respectively which are provided on the corresponding contact surfaces which face each other. The aforementioned engaging means 241, 251 advantageously consist of longitudinal grooves extending in the direction of the tubular profiles 19, 119 in such a way that preadjustment can be achieved by an appropriate interlocking of the catching plate 250 and of the door stop 240 in the direction of the arrow denoted K. It is thus possible to take account of the size of the tubular profile 19 to which the fastener device is to be fitted. This is clearly illustrated in FIGS. 12 and 13. A cushioning strip 243 is advantageously provided between the catching plate 250 and the tubular profile 19 so as to deaden the noise when the door is closed. Furthermore, it removes any play so that the door finds itself completely immobilized when closed and no longer experiences rattling, for example in the event of wind, etc. As a preference, the cushioning strip is made of a synthetic material.

Figure 14:
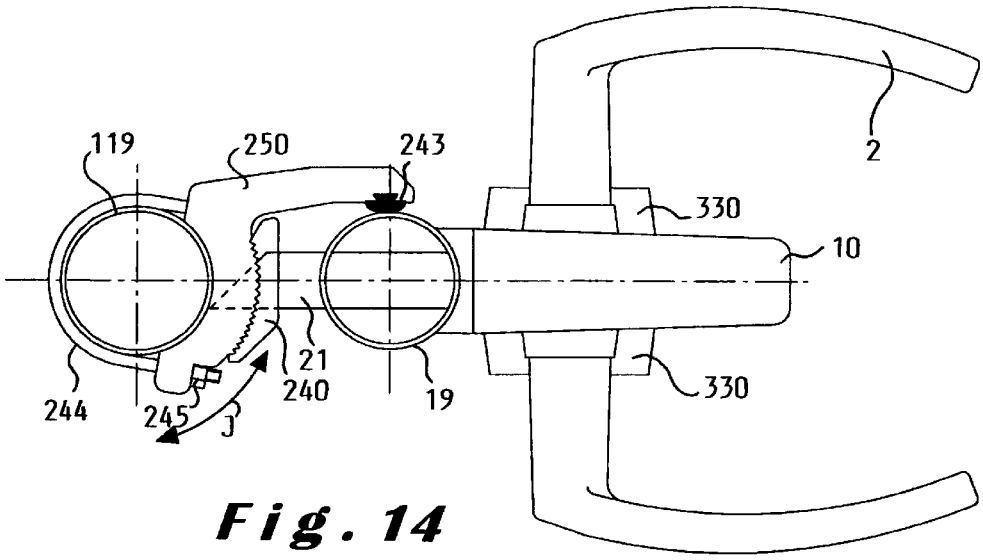
FIGS. 14 and 15 are views similar to FIGS. 12 and 13 respectively of a second alternative form of the device.
Figure 15:
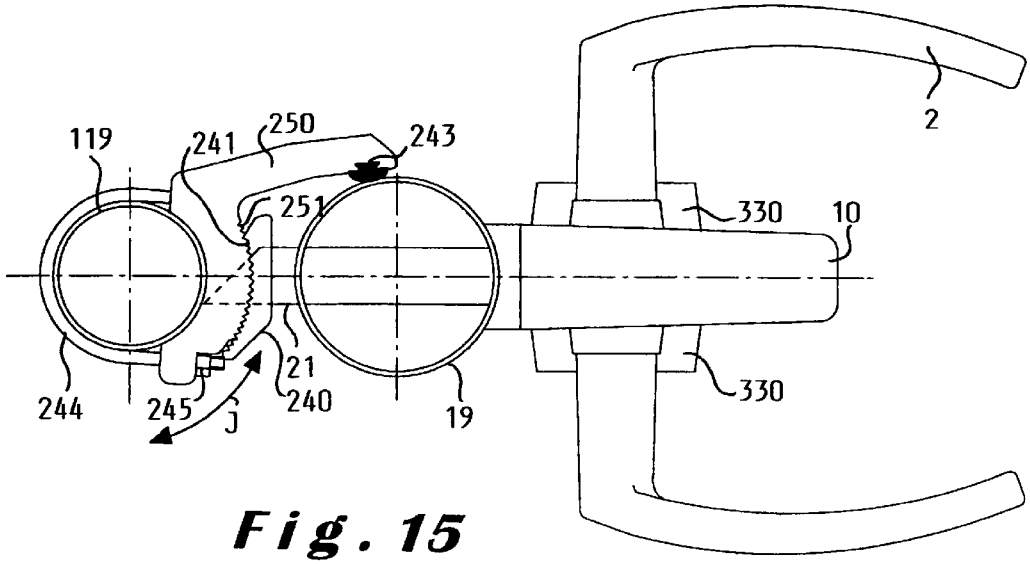

FIGS. 14 and 15 illustrate a similar mounting for round profiles where the contact surfaces co-operate via engaging means 241, 251 belonging respectively to the door stop 240 and to the catching plate 250, of rounded shape, so that adjustment is by a rotational movement denoted by the arrow J. In this way, smaller or larger diameters of tubular profiles 19 may be accounted for. For the instance of striker plates for round profiles, as illustrated in FIG. 18, attachment is by means of a collar 244 and nuts 245 and no additional holes need be drilled in the profiles 119.

Figure 17:
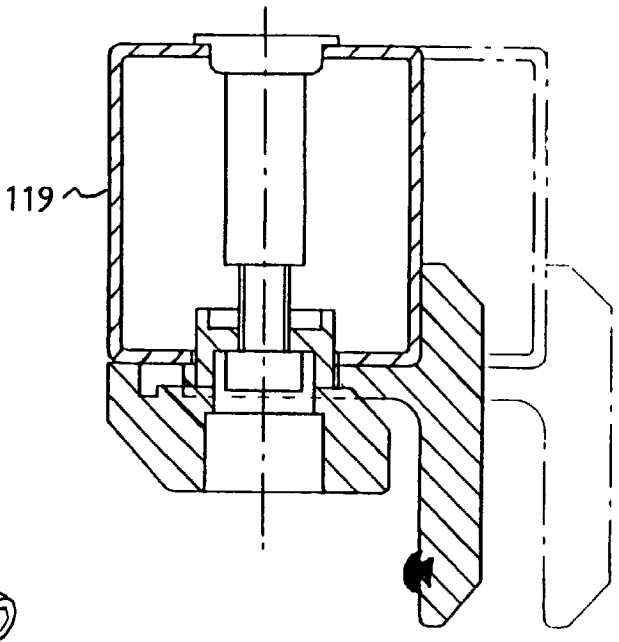
FIGS. 16 and 17 each illustrate views of a part of a device similar to the device according to FIG. 12 respectively in the exploded and in the assembled state.
Figure 16:
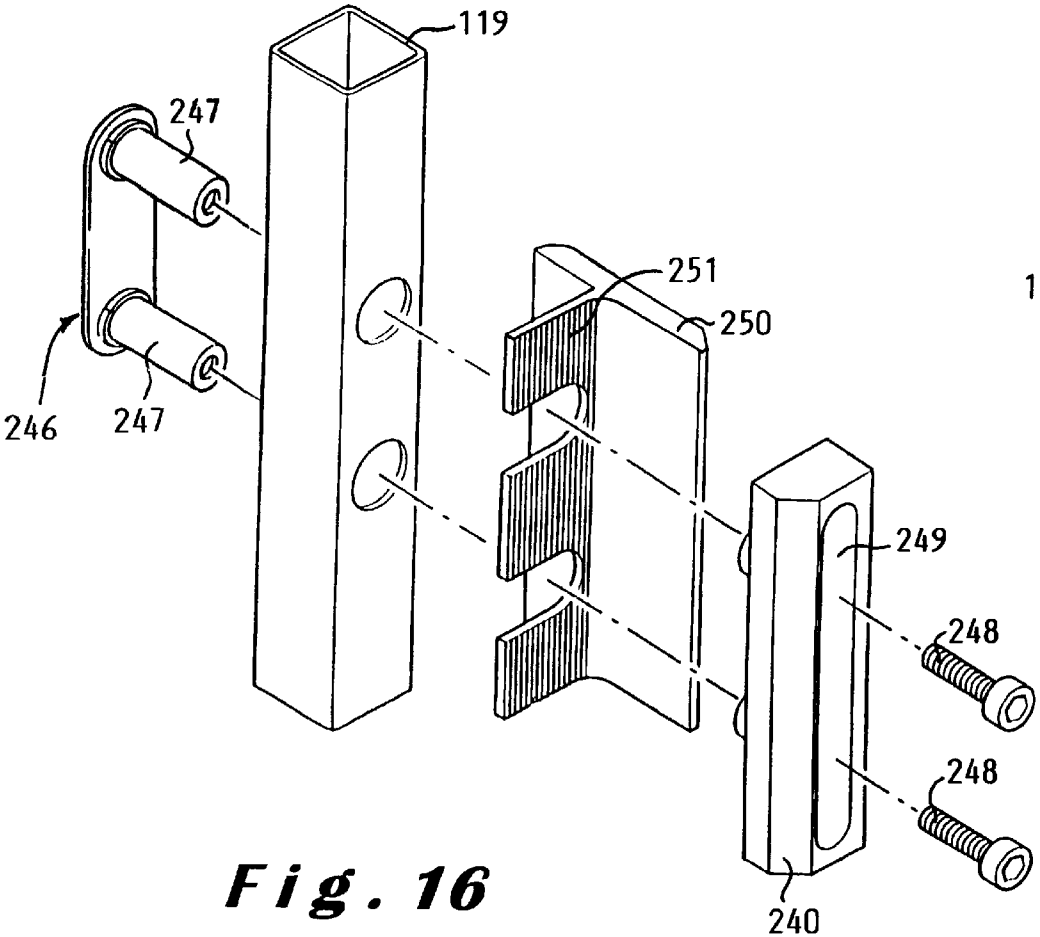
Figure 18:
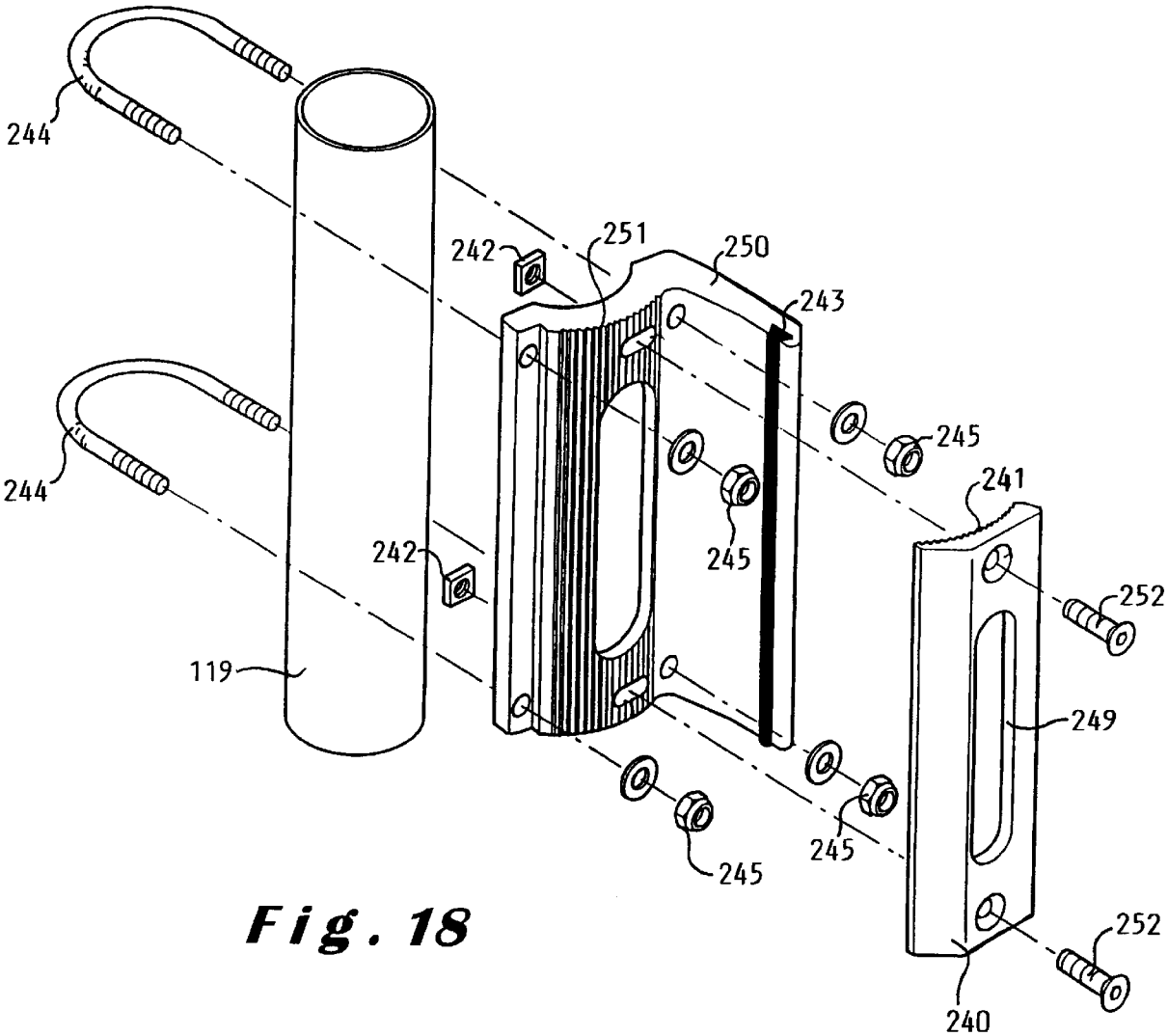
FIG. 18 illustrates a view similar to FIG. 16 of the device according to FIG. 14.

The aforementioned contact surface made in the form of grooves 241 and 251 can be seen more clearly for the square or round tubular profiles in FIGS. 16 and 18 respectively. It should be noted that the embodiment illustrated in FIG. 16 is very similar to the embodiment illustrated in FIGS. 12 and 13 but differs from this embodiment in that the catching plate 250 is not L-shaped but T-shaped. As illustrated in FIG. 17, the position of the catching plate 250 is thus determined by the thickness of the upright 119 facing the upright to which the lock is mounted. For mounting the accepting means to the square tube 119, FIG. 16 shows clearly that a U-shaped piece 246 is provided showing bushings 247 which can be inserted in holes in the tube 119 and wherein screws 248 can be screwed to fix the door stop 240, showing a slot 249 for the latch bolt and the dead bolt, and the catching plate 250 to the tube 119. For the round tube 119 illustrated in FIG. 18, the door stop 240 is fixed by means of nuts 242 and bolts 252 to the catching plate 250 which is fixed by means of the collars 244 and the nuts 245 to the tube 119.

By virtue of the way in which the engaging means 241, 251 of the aforementioned contact surfaces are produced and of the adjustment K or J that this allows, according to the shapes and/or sizes of the tubular profiles, just one catching plate 250 is needed for the square or round tubular profile. There is thus obtained a standard lock device with dimensions that can vary for example from 40 to 80 mm, as is clear from FIGS. 12 to 15.

The way in which the fastener device according to the invention operates is as follows. The latch bolt 21 is actuated by one of the handles 2 and the deadlock bolt 22 by inserting a safety key 1 into the profiled keyhole 3 of one of the rotary cylinders of the safety lock 108. When the fastener device is first mounted, the initial position of each bolt 21, 22 is selected as a function of the transverse dimensions of the support tube 19. As explained hereabove, the latch bolt 21 can easily be adjusted by rotating the threaded shank 226 by means of a hexagonal key inserted through the distal extremity 72 either clockwise or anti-clockwise thereby adjusting the distance over which the latch bolt projects out of the lock to the diameter of the upright to which it is fixed and also to the width of the gap between this upright and the opposite upright to which the keep is mounted.

This form of adjustment gives continuous adjustment by virtue of the threaded internal shank 226 provided. The abutment or slide element 222 cooperates with this shank 226 by moving on it actually within the latch bolt inside the slot 223 which determines the travel of the slide element 222 intended to cooperate with the lever 66 of the wheel 25.

The deadlock bolt 22 can also be adjusted when the lock is already mounted on the upright. More specifically, in the latter instance, the set screw 208 of the deadlock bolt 22 is first of all unscrewed using the aforementioned L-shaped hexagonal key. Next, the position of the bolt 22 is adjusted by rotating the end part 201 of this component 22 to the right or to the left depending on whether the bolt is to be made to protrude less or, on the other hand, more. To finish off, the aforementioned set screw 208 of the deadlock bolt is tightened again.

The latch bolt 21 and deadlock bolt 22 may thus be adjusted from the outside using an additional key.

A great advantage is obtained by virtue of the aforementioned continuous adjustment consists in the fact that it is thus possible to change the adjustment of the bolts of the device without having to remove the lock, thus leaving it mounted on the door itself. The continuous adjustment also allows an accurate adjustment of the distance over which the latch bolt projects out of the upright to enable the door to be slammed without any manipulation of the lock or handle being required for closing this door.

The mechanism for actuating the deadlock bolt 22 works as follows. The deadlock bolt 22 slides axially according to the direction of rotation given to the safety key 1, in turn imparting to the safety lock 108 in the known way a movement of rotation in the direction of the arrow indicated by the reference H. Prior to this, the deadlock bolt 22 is adjusted as a function of the transverse dimensions of the support tube 19 as was the case for the latch bolt 21. In the embodiment illustrated in the drawings, the deadlock bolt 22 may be adjusted by selectively positioning one of the notches 76, 77, 78 of the deadlock bolt 22 with the possibility of adjusting the latter 22 according to the section of the support tube 19, as well as of reusing the same fastener device with support tubes of differing transverse dimensions. For this all that is required is for the deadlock bolt 22 to be repositioned differently with respect to the safety lock 108. Moreover, it can also be adjusted from the outside of the lock as explained already hereabove, possible in addition to the adjustments by means of the notches, for example to achieve an accurate adjustment of the length of the dead bolt.

As it rotates, an element of the lock cylinder 108 which projects radially, such as a bit 106, comes into contact with the trailing edge 48' of the small plate 50 acting as a catch, which hitherto was in a state of rest and still engaged via its projecting loop 53 in one of the cuts 83 of the deadlock bolt, then raises this, the deadlock bolt 22 at this stage in the movement still remaining immobile. The raising against the action of the spring 54 of the small plate 50 acting as a locking member with respect to the deadlock bolt 22 makes its loop 53 disengage progressively from the cut 83 and thus release the deadlock bolt 22. Thus, by continuing to rotate the key 1, the bit continues its rotational movement and thus makes the deadlock bolt 22, now released, slide axially in the direction of the arrow indicated by the reference E. When the bit has completely left the slot 76 of the bolt 22, one of the cuts 83 is positioned facing the projecting loop 53 of the small plate. Under the action of the loop-shaped part 54 of the spring 176, which is compressed, the projecting loop 53 is brought back into the cut 83 lying facing it. By carrying out a sliding movement returning it to its initial position of rest, the small plate 50 thus locks the deadlock bolt 22 in the position into which it has been brought by rotating the key, namely the open or the fastened position, if appropriate with double turn.

It emerges from the foregoing that the position of the cuts 83 along the deadlock bolt 22 is determined by the position of the notch or notches 76, 77, 78 therein. Furthermore, at least two cuts 83, one for locking the bolt 22 via the catch 55 in the open position and the other for locking the bolt in the fastened position advantageously correspond to each notch 76, 77, 78. For multiple-turn locks, additional cuts 83 are provided, preferably one additional cut per notch 76, 77, 78. It goes without saying that as appropriate some cuts could have dual uses so that the number of these compared with the number of notches can be reduced. Furthermore, the width of the notches measured along the axis of the bolt 22 with respect to the width of the bit is such that there is play between the bit and each notch, allowing the bit to move therein as described hereinabove.

In order to avoid deflection or undesired lateral displacement of the loop-shaped part 54 of the spring 176, the guide eye 39 of the deadlock bolt 22 is provided with a projection 17 designed to act as a guide for the free branch 46 of the loop-shaped portion 54 of the spring 176.

The fastener device according to the invention comprises a lock which can be used particularly for metal swing gates and doors, opened by a handle and/or by the cylinder, that is to say without a handle, and for forged iron gates and gateways, particularly for parks and sports grounds and also for hoardings or industrial doors. Furthermore, the aforementioned fastener devices comprise a lock which can be adapted both to tubular profiles of square or flattened rectangular section and to profiles of a round section, while at the same time being adjustable to suit profiles of different dimensions as illustrated in FIGS. 12 to 18. In addition, FIG. 19 clearly illustrates how the lock of the fastener device of a square tubular profile can be adapted easily to suit a round profile and vice versa, simply by inserting an adaptor plate 199 for the round section.

In the device illustrated in FIG. 1, it will be seen that not only the dead bolt but also the latch bolt can be unlocked by means of the lock cylinder so that optionally the handles may be omitted. The first turn of the key 1 in the cylinder retracts the deadlock bolt 22, while the second turn of the key 1 retracts the latch bolt 21 due to the fact that by the retraction of the dead bolt, the second turn pusher has moved into the path of the drive bit 106 of the lock cylinder.

Furthermore, mounting the device on the aforementioned tubular profiles is easy and presents no risk of adversely affecting the robustness of the assembly in that all that is required is for two holes to be drilled in the tubular profile 19 so that the lock can be applied to this part 19. A tool made up of a drilling template and of a stepped drill bit allows precious time to be saved when preparing tubular profiles for mounting. The holes 56, 58 in the tubular profile 19 are produced in a single operation using the aforementioned drill bit.

The fastener device can be adapted to each tube profile. Furthermore, given that the locking plugs or bushings 91, 92 can be moved in a trice using additional keys 97, various profiles and sizes of profile can be reconciled. Furthermore, as mentioned above, mounting is extremely quick and easy and can be achieved in under a minute by first of all drilling or punching out two holes 56, 58 in the tubular profile 19 and then placing the lock 10 on the door, inserting each of the bolts 21 and 22 in the orifices 56 and 58 which have just been formed and finally fixing the said lock 10 in place using the additional key 97. The casing incorporates preferably a reinforcement 330 safeguarding the lock cylinder so that it is practically impossible to destroy. The reinforcement 330 is advantageously cast in the casing so that it is integral with it. This then yields a universal fastener device that can be fitted to all standard basic frames with closure mechanism. By virtue of the use of the aforementioned reinforcements 330, preferably integral with the casing 10, it is contrived that the entire length of the cylinder 108 is housed inside the casing. The lock is fixed in place from inside the tubular profile using a locking plug 91, 92 which passes through the tubular profile of the door.

Advantageously, the assembly is made of an entirely rustproof material. Thus, by virtue of the use of exclusively rustproof material, such as aluminium, brass and/or stainless steel, the fastener device thus obtained is safeguarded against wear by oxidation for a very long time.

In addition, the fastener device described hereinabove cannot be "picked", thus making it possible to make the closing of any door entirely effective because its construction is very robust and it is fastened on very securely, this being the result of the fact that no fastening bolts can be undone after the door has been closed, as is apparent, for example, from FIG. 3.

From the above description of a particular embodiment of the invention, it will be clear that many modifications can be applied thereto as to the shape, composition, etc. of the lock without departing from the scope of the invention as defined in the appended claims.

What is claimed is:

1. A fastener device for a door or a gate and adapted to engage an upright, including a lock comprising:

a frame with a carrier plate and an edge plate, the frame being arranged to be mounted with said edge plate against said upright;

at least a latch bolt having a predetermined length and comprising a main bolt part, formed by a first bolt part having a length corresponding to said predetermined length of the bolt, and a second bolt part having an abutment element and cooperating with the main bolt part, which main bolt part is guided at least in a first and a second guide on the frame to be movable between a retracted and a projecting position and has a distal extremity which extends in said projecting position over a predetermined distance out of the end plate to project beyond said upright;

an actuation mechanism arranged to move said main bolt part from its retracted to its projecting position and vice versa and comprising a spring acting on the second bolt part and through the intermediary of said second bolt part, said spring acting on the first bolt part to urge the latch bolt to its projecting position and an operating member acting on said abutment element to move the main bolt part from its protecting position to its retracted position; and means operable from outside the fastener device for bringing the main bolt part in different axial positions with respect to the second bolt part and for fixing the main bolt part in these positions to the second bolt part to adjust said predetermined distance over which said distal extremity extends in the projecting position out of the edge plate, the length of the main bolt part being such that in said different axial positions, in the projecting position of the bolt, the main bolt part remains guided by said first and second guides.

2. The fastener device as claimed in claim 1, wherein said second bolt part comprises a slide element which is slidably mounted in said first bolt part and which is provided with said abutment element, said means for bringing the main bolt part in different axial positions with respect to the second bolt part and for fixing it in these positions to the second bolt part comprising a threaded shank extending axially within the first bolt part and engaging the slide element and the first bolt part, which threaded shank is accessible through an axial hole provided in said distal extremity to rotate it either clockwise or anti-clockwise to slide said slide element axially in the first bolt part.

3. The fastener device as claimed in claim 2, wherein said threaded shank is rotatably mounted in one predetermined axial position in the first bolt part and is screwed in an axial threaded hole in said slide element.

4. The fastener device as claim in claim 1, wherein the device comprises at least one handle rotatably mounted on a handle shaft and a follower mounted on this shaft, and wherein the aforementioned operating member comprises a ring having a cylindrical external profile delimited by two practically parallel sides and a stub arranged radially on the outside periphery of the cylindrical profile to act on the abutment element on the latch bolt, the ring being attached via one of the aforementioned sides to the follower forming a hub so as to form a partially annular groove in which a return means for said handle is housed.

5. The fastener device as claimed in claim 1, wherein a means is provided for accepting at least the latch bolt of the lock, which means is intended to be arranged on an opposite upright facing the upright.

6. The fastener device as claimed in claim 5, wherein the accepting means comprises an accepting plate in which there is provided at least one orifice for accepting the corresponding bolt in alignment therewith, and a grab plate attached thereto and intended to be grasped by the user.

7. The fastener device as claimed in claim 6, wherein the accepting plate and the grab plate are set with respect to each other at an angle ($\alpha$) of between 35 and 55°.

8. The fastener device as claimed in claim 6, wherein the grab plate is fitted with an element forming a handle which is attached to it.

9. The fastener device as claimed in claim 8, wherein the handle element is made of a synthetic material.

10. The fastener device as claimed in claim 5, wherein the accepting means acts at one and the same time as an accepting plate for the introduction of the bolt, as a means of consolidating the locking effect through the presence of openings in which the bolt can be locked, and as a handle allowing a second leaf of a revolving double door to be opened.

11. The fastener device as claimed in claim 1, wherein the latch bolt has a leading end which is beveled, at between 30° and 60°.

12. The fastener device as claimed in claim 1, wherein the abutment element on the second bolt part is positioned between said first and second guide.

13. The fastener device as claimed in claim 1, wherein the upright has a diameter of at least 40 mm.

14. A fastener device for a door or a gate and adapted to engage an upright, including a lock comprising:

a frame with a carrier plate and an edge plate, the frame being arranged to be mounted with said edge plate against the upright;

at least one bolt slidably mounted on the frame between a retracted and a projecting position and extending in its projecting position with a distal extremity over a predetermined distance out of the edge plate and extending beyond said upright; and an actuation mechanism arranged to move said bolt from its retracted to its projecting position and vice versa and comprising an operating member acting on an abutment element on the bolt, which abutment element is separated by a predetermined length of the bolt from said distal extremity thereof, wherein said bolt comprises a first part having said distal extremity and a second part provided with said abutment element and means operable from a projecting portion of the bolt to move the first and second parts axially with respect to one another and to fix them in different axial positions to one another, which means comprise a screw thread on said first bolt part and a corresponding screw thread on said second bolt part having a screw axis directed according to a longitudinal axis of the bolt, the first and the second bolt parts being screwable onto one another over different overlapping distances to adjust said predetermined length of the bolt and thereby said predetermined distance over which the bolt projects out of the edge plate, one of said screw threads being an inner screw thread and another of said screw threads an outer screw thread provided on a projecting portion of the part onto which the outer screw thread is provided, an axial hole being provided through the distal extremity of the bolt and at least into said projecting portion, the hole being provided at least in said projecting portion with an internal screw thread and the lock comprises a set screw arranged to be screwed in said hole to lock said projecting portion in said inner screw thread by laterally expanding said projecting portion therein.

15. The fastener device as claimed in claim 14, wherein at least a distal portion of said projecting portion is cut axially into at least two halves, which halves are arranged to be separated radially from one another when screwing said set screw in said hole.

16. The fastener device as claimed in claim 15, wherein said hole is tapering between said two halves in a direction away from the distal extremity of the bolt.

17. The fastener device as claimed in claim 14, wherein said bolt is a dead bolt, wherein the lock comprises means for locking the dead bolt in retracted and projecting positions, and wherein said actuation mechanism comprises a cylinder having a bit as the operating member operable by means of a key.

18. A fastener device for a door or a gate and adapted to engage an upright, including a lock comprising:

a frame with a carrier plate and an edge plate, the frame being arranged to be mounted with said edge plate against said upright;

at least one bolt having a predetermined length and comprising a main bolt part, formed by a first bolt part having a length corresponding to said predetermined length of the bolt, and a second bolt part having an abutment element and cooperating with the main bolt part, which main bolt part is guided at least in a first and a second guide on the frame to be movable between a retracted and a projecting position and has a distal extremity which extends in said projecting position over a predetermined distance out of the end plate to project beyond said upright;

an actuation mechanism arranged to move said main bolt part from its retracted to its projecting position and vice versa and comprising an operating member acting on said abutment element; and means operable from outside the fastener device for bringing the main bolt part in different axial positions with respect to the second bolt part and for fixing the main bolt part in these positions to the second bolt part to adjust said predetermined distance over which said distal extremity extends in the projecting position out of the edge plate, the length of the main bolt part being such that in said different axial positions, in the projecting position of the bolt, the main bolt part remains guided by said first and second guides, wherein said second bolt part comprises a slide element which is provided with said abutment element, which projects through at least one slot out of the first bolt part and which is slidably mounted in said first bolt part between a first position wherein it engages one end of said slot and a second position wherein it engages an opposite end of said slot, said means for bringing the main bolt part in different axial positions with respect to the second bolt part and for fixing it in these positions to the second bolt part comprising a threaded shank extending axially within the first bolt part and engaging the slide element and the first bolt part, which threaded shank is accessible through an axial hole provided in said distal extremity to rotate it either clockwise or anti-clockwise to slide said slide element axially in the first bolt part.

* * * * *